US005100075A

United States Patent [19]

Morand

[11] Patent Number: 5,100,075

[45] Date of Patent: Mar. 31, 1992

[54] CORE REMOVING TISSUE DISPENSER

[75] Inventor: Michel Morand, Montreal, Canada

[73] Assignee: Wyant & Company Limited, Lachine, Canada

[21] Appl. No.: 480,634

[22] Filed: Feb. 15, 1990

[30] Foreign Application Priority Data

Aug. 16, 1989 [GB] United Kingdom ..... 8918668

[51] Int. Cl.[5] ..... A47K 10/32; A47K 10/38; B65H 16/02; B65H 19/12

[52] U.S. Cl. ..... 242/55.2; 242/55.3; 242/55.42; 206/389; 206/394; 211/72; 211/123; 248/905; D6/523

[58] Field of Search ..... 248/905, 309.2; 211/72, 211/123, 124, 105.1, 163, 164, 16; 242/55.3, 55.2, 55.53, 55.42, 55.54; 206/389, 390, 391, 394; D6/523, 522, 521, 520

[56] References Cited

U.S. PATENT DOCUMENTS

| | | | |
|---|---|---|---|
| 462,310 | 11/1891 | Gardner | 242/55.2 |
| 469,855 | 3/1892 | Hicks | 242/55.2 |
| 479,971 | 8/1892 | Carr | 242/55.2 |
| 586,128 | 7/1897 | Hoberg | 242/55.2 |
| 765,588 | 7/1904 | McGown | 242/55.2 |
| 1,053,159 | 2/1913 | Crush | 242/55.42 |
| 1,437,157 | 11/1922 | Simcox et al. | 242/55.2 |
| 2,632,605 | 3/1953 | Lee | 242/55.2 |
| 2,707,595 | 5/1955 | Brown | 248/905 X |
| 3,157,370 | 11/1964 | Govatsos | 242/55.2 |
| 3,484,052 | 12/1969 | Clarke | 242/55.42 |
| 4,143,827 | 3/1979 | Tucker | 242/55.3 |
| 4,218,027 | 8/1980 | Pool | 242/55.2 |

FOREIGN PATENT DOCUMENTS

| | | | |
|---|---|---|---|
| 332391 | 9/1989 | European Pat. Off. | 242/55.3 |

*Primary Examiner*—Stuart S. Levy
*Assistant Examiner*—Joseph A. Rhoa
*Attorney, Agent, or Firm*—Larson and Taylor

[57] ABSTRACT

The invention is to a spindle for use in mounting a toilet paper roll thereon, and more particularly, for use in mounting a coil of toilet paper, without the core, on the spindle. The spindle has a flange near its outer end that stops movement of the core as the toilet paper roll is pushed onto the spindle during mounting. Continued pushing of the roll onto the spindle while the core is stopped, strips the coil of paper off the core. The coil ends up on the spindle and the core is disposed of.

15 Claims, 4 Drawing Sheets

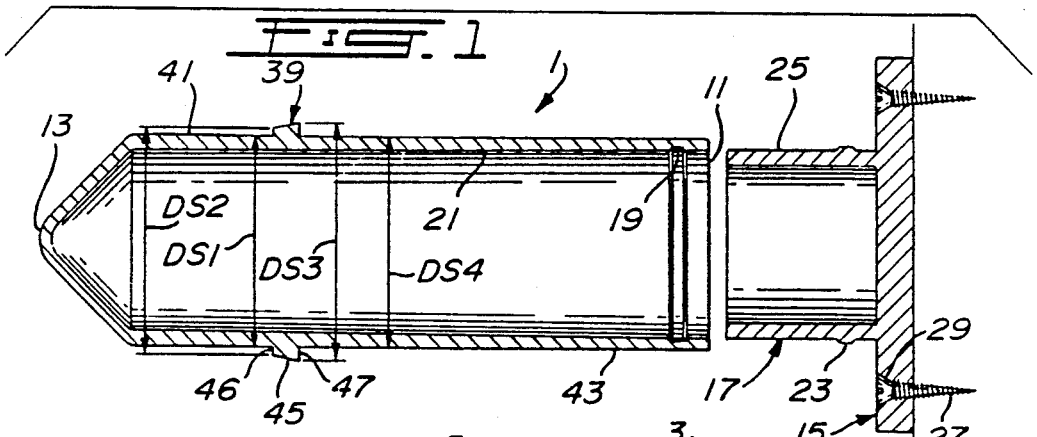
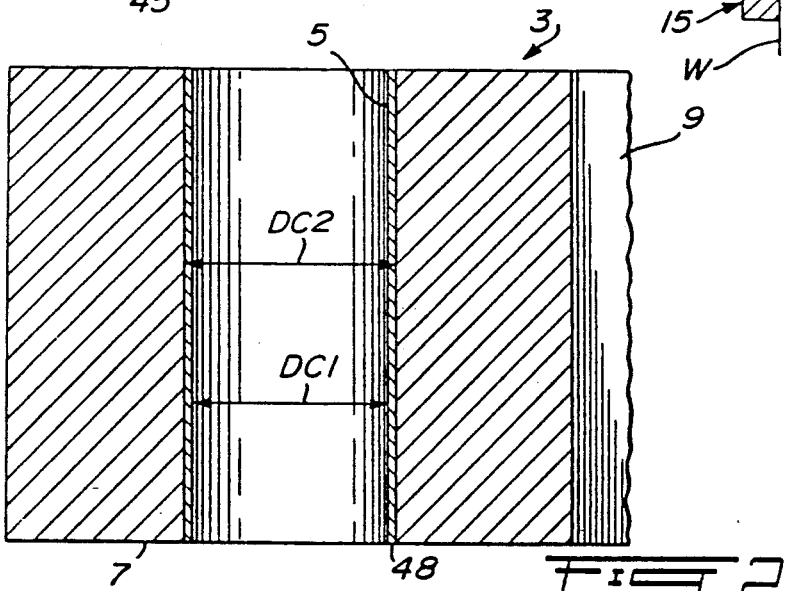
FIG. 2
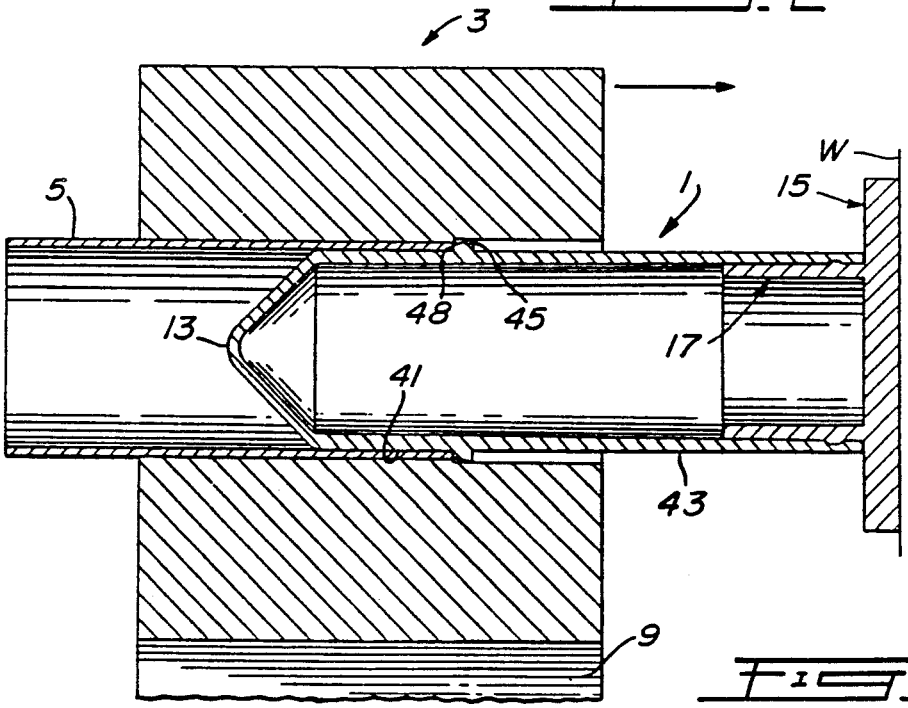
FIG. 3

CORE REMOVING TISSUE DISPENSER

This invention is directed toward a spindle for use in mounting a roll of toilet paper. The invention is also directed toward a "two-roll" toilet paper dispenser incorporating the spindle.

The invention is further directed toward a method of mounting toilet paper on a spindle.

A toilet paper roll normally comprises a very long sheet of toilet paper snugly wrapped in a coil on a cardboard core. The roll is prepared for use by mounting it on a spindle which freely passes through the core. Toilet paper is pulled off the roll while it rotates on a spindle.

Once the toilet paper is all used up, the core is removed from the spindle and a new roll is placed on the spindle. If it is left for the user to dispose of the spent core, as particularly happens with two-roll dispensers, the core is often flushed down the toilet. This can clog the toilet.

It is therefore the purpose of the present invention to provide a toilet paper dispenser, particularly a "two-roll" toilet paper dispenser, which eliminates the handling of an empty toilet paper roll core by a user.

In accordance with the present invention, a standard toilet paper roll is handled in such a way when mounting it on a special spindle that only the coil of paper is mounted on the spindle. The core is separated from the coil of paper while mounting it on the spindle, and disposed of at that time by the maintenance personnel. When the toilet paper forming the coil is all used up, there is no empty core left on the spindle to be disposed of.

The present invention is directed toward a novel spindle on which the toilet paper is mounted. The spindle has a generally cylindrical shape with a free end and a mounting end. The spindle is rotatably mounted via its mounting end. Stop means, preferably in the form of a circumferential flange, are located on the surface of the spindle near its free end. The stop means divides the spindle into a short spindle section and a long spindle section. The short spindle section has a diameter generally equal to the inner diameter of the core of the toilet paper roll. The stop means has an outer diameter generally equal to the outer diameter of the core.

The toilet paper roll is first mounted on the spindle by pushing it onto the short section of spindle which snugly enters the core. Continued pushing of the roll onto the spindle causes the inner end of the core to abut the stop means. Further pushing causes the coil of toilet paper to slide off the core and move over the stop means onto the long section of the spindle. The empty core is disposed of. Toilet paper is pulled off the coil, which rotates either freely on the spindle, or with the spindle, as desired.

The invention is particularly useful in a novel "two-roll" toilet paper dispenser. "Two-roll" toilet paper dispensers normally have a first roll at an operative position in the dispenser where toilet paper can be taken off the roll and a second roll at a storage position in the dispenser, usually above the operative position. When the first roll is used up, the second roll is moved down from the storage position to the operative position. Normally, in using "two-roll" toilet paper dispensers, the user must dispose of the core of the first roll at the operative position before the second roll can be moved from the storage position in the dispenser to the operative position. However there often are no waste receptacles in toilet cubicles, particularly in men's toilets, and the empty core may be disposed of in the toilet.

The present invention allows both rolls to be mounted on the dispenser without their cores. Thus there is never any core for the user to dispose of. The "two-roll" dispenser of the present invention employs a spindle means having a first lower spindle at a lower operative position in the dispenser and a second upper spindle above the first spindle at an upper storage position in the dispenser. The upper spindle has stop means on it for use in removing the core from a toilet paper roll when it is mounted on the spindle. The first roll is mounted on the upper spindle, its core removed during mounting. This first "roll", actually the coil, is them moved downwardly onto the lower spindle to be in the lower operative position in the dispenser. A second roll is then mounted on the upper spindle, its core also removed during mounting. The second "roll" or coil remains on the upper spindle in the upper storage position on the dispenser. When the first coil is used up, the second coil is moved down from the storage position to the operative position. During regular maintenance of the dispenser, a third roll is mounted on the now empty upper spindle, its core removed during mounting. It is seen that there are no core disposal problems for the user of the "two-roll" dispenser since the cores are removed during loading of the dispenser.

The invention is particularly directed toward a spindle for use in mounting a roll of toilet paper thereon, the toilet paper roll comprising a long sheet of toilet paper wound in a coil on a core. The spindle has a generally cylindrical shape and means at one end for use in rotatably mounting the spindle. The spindle has means near its other free end for use in removing the core from a roll of toilet paper as the roll is pushed onto the spindle over its free end.

The invention is also particularly directed toward a method of mounting a toilet paper roll on a spindle, the toilet paper roll comprising a long sheet of toilet paper wound in a coil on a core. The method comprises pushing the roll onto the spindle from one end while simultaneously stopping movement of the core to push the coil off the core onto the spindle.

The invention will now be described in detail having reference to the accompanying drawings in which:

FIG. 1 is a cross-section view of the spindle and a mounting plate.

FIG. 2 is a cross-section view of a toilet paper roll;

FIG. 3 is a cross-section view of the toilet paper roll being installed on the spindle;

Figures 4, 5, 6, 7:
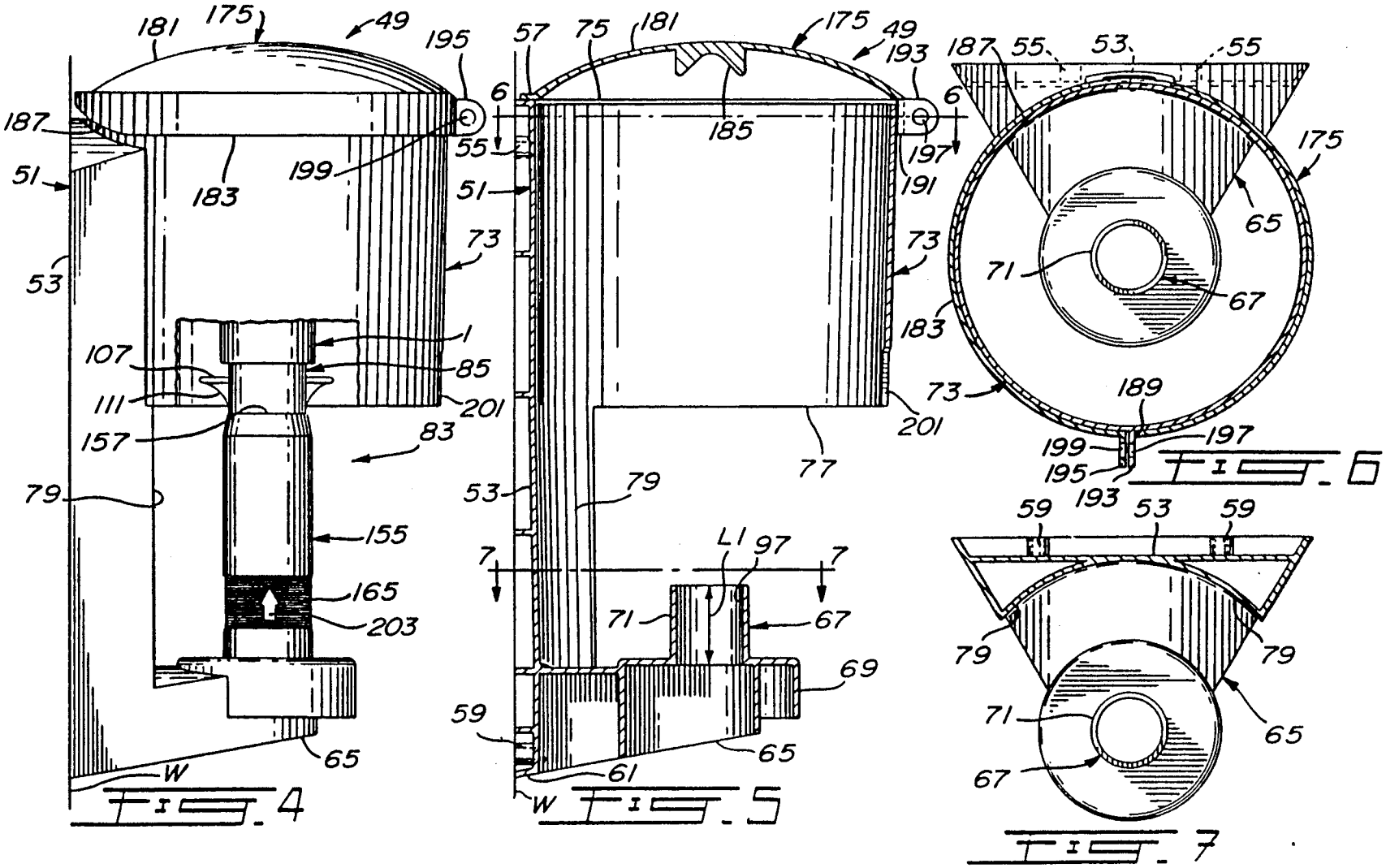
FIG. 4 is a side view of the "two-roll" toilet paper dispenser.
FIG. 5 is a cross-section view of the base of a "two-roll" dispenser.
Figure 12:
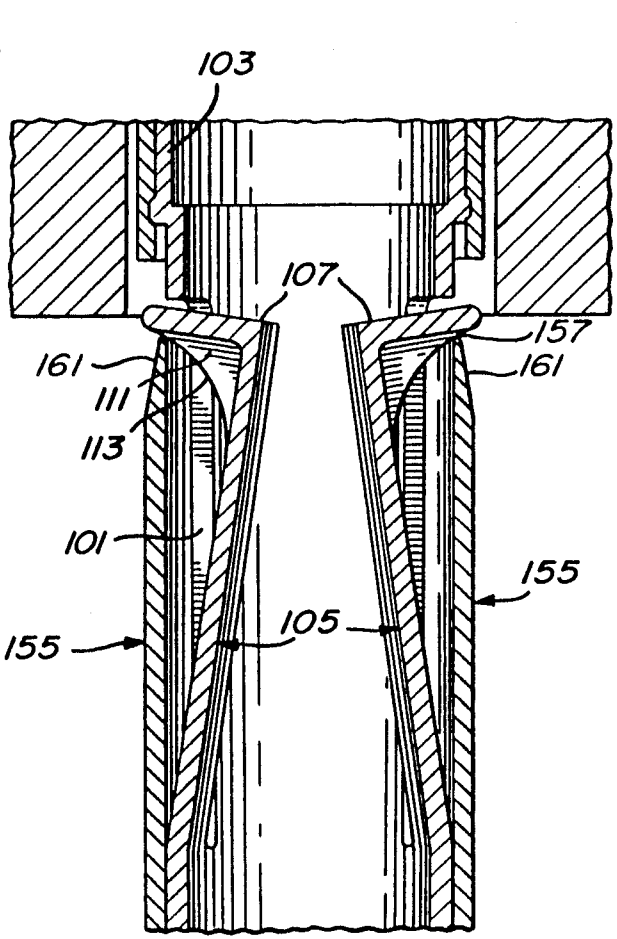
Figure 9:
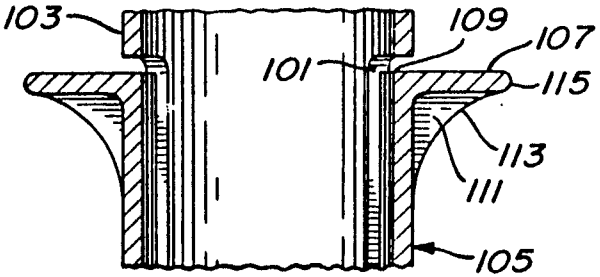
Figure 10:
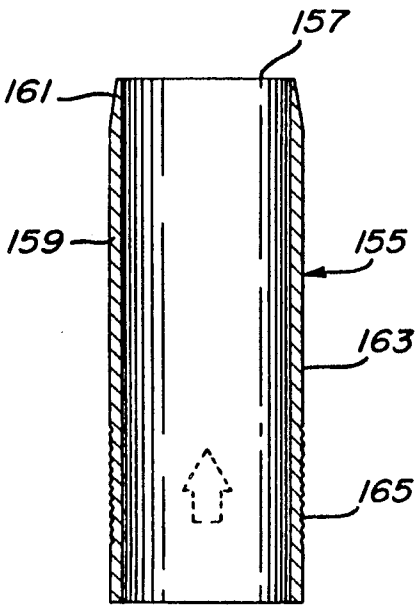
Figure 8:
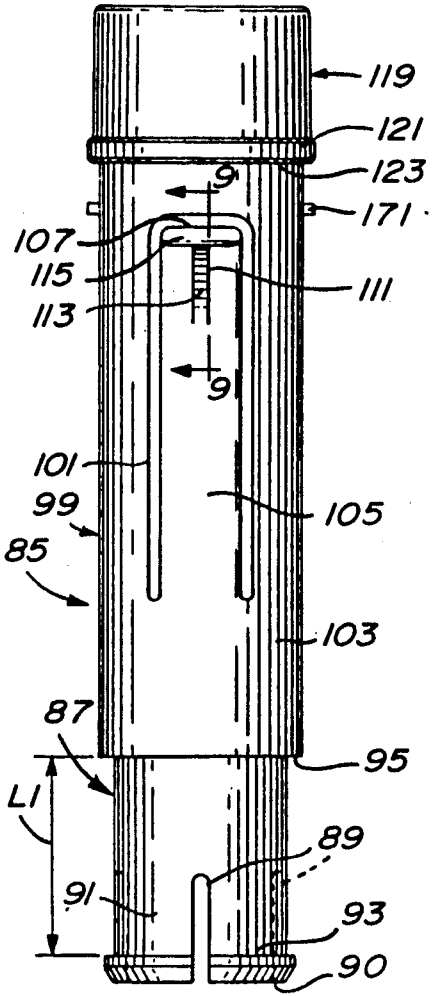
Figure 13:
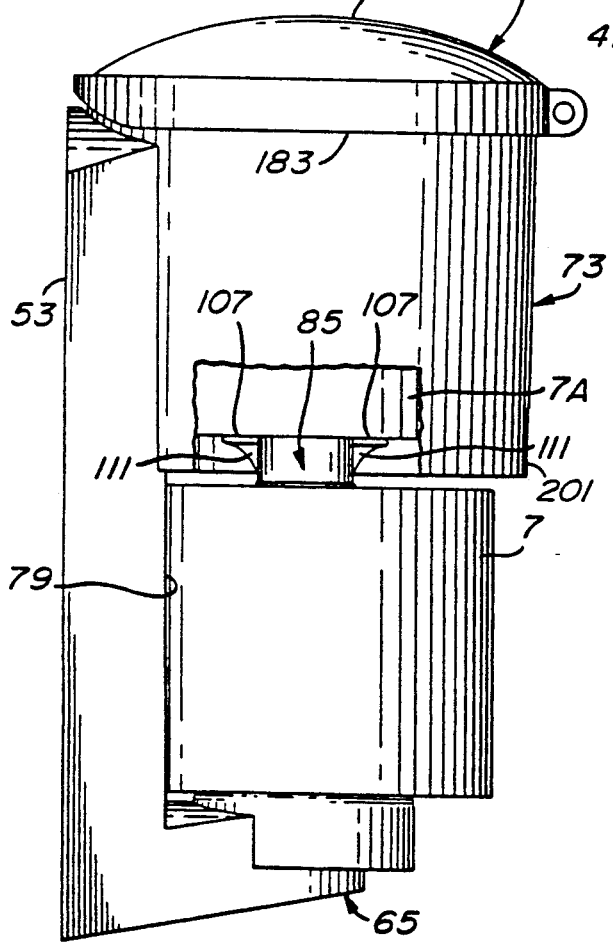
Figure 11:
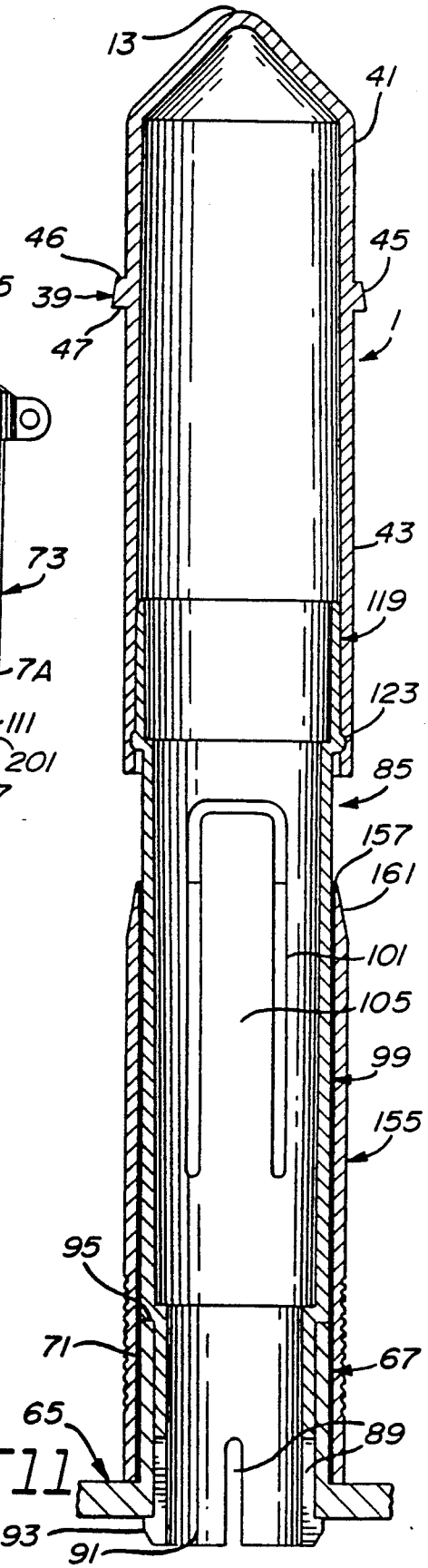

FIG; 6 is a cross-section view of the base taken along line 6—6 of FIG. 5;

FIG. 7 is a cross-section view taken along line 7—7 of FIG. 5;

FIG. 8 is a side view of the lower spindle;

FIG. 9 is a cross-section view taken along line 9—9 of FIG. 8;

FIG. 10 is a cross-section view of the spindle sleeve;

FIG. 11 is a cross-section view of the assembled spindle means;

FIG. 12 is a detailed cross-section view of the stop means on the lower spindle; and FIG. 13 is a side view of the dispenser with the two "rolls" in position.

The invention in its broadest sense, is directed toward a spindle 1 as shown in FIG. 1 for use in handling a roll 3 of toilet paper as shown in FIG. 2. The toilet paper roll 3 is of a standard size, about four inches long and five inches in diameter, and comprises a tubular core 5, usually made from thin cardboard, and a large coil 7 of toilet paper 9 in sheet form snugly wound onto the core 5.

The inner end of the toilet paper 9 is usually attached to the surface of the core 5 with a suitable glue to assist in the start of winding the paper 9 onto the core 5 to form the coil 7. The glue attachment prevents the paper from slipping off the core during the start of winding. In accordance with the present invention, the inner end of the toilet paper 9 is attached to the surface of the core 5 with a "fugative" or hot pick-up glue. "Fugative" glue is well known and comprises a glue that is tacky and adhesive when wet and that is substantially non-adhesive when dry. Thus the "fugative" glue, when initially applied, is tacky and causes the inner end of the paper to adhere to the core. When the glue dries however it becomes non-adhesive and the inner end of the paper no longer adheres to the core. This makes it easier to remove the coil 7 of toilet paper 9 off the core 5 as will be described. A suitable "fugative" adhesive is one sold under the Identification No. 79-3356 by Nacan Products.

The spindle 1 is generally cylindrical in shape, and preferably tubular, with a flat, open, base end 11 and a rounded, outer end 13. The spindle 1 is rotatably mounted on a mounting plate 15. The mounting plate 15 has a short, tubular mounting member 17, centrally located on the plate and projecting laterally therefrom. The mounting member 17 is sized to fit within the spindle 1 through its open base end 11. A circumferential groove 19 in the inner surface 21 of the spindle 1 near its base end 11 cooperates with a circumferential bead 23 on the outer surface 25 of the mounting member 17 to lock the spindle 1 on the mounting member 17 against axial movement while permitting the spindle 1 to rotate on the mounting member 17. The mounting plate 15 can be mounted flat against a wall "W" with suitable fastening means 27 passing through holes 29 in the corners of the plate. In this case the spindle 1 is horizontal. If it is desired to have the spindle 1 vertical, the plate 15 can be mounted on the horizontal arm of a right-angled bracket (not shown) with the vertical arm of the bracket mounted on a wall "W" with suitable fastening means.

The spindle 11 has circumferentially extending stop means 39 located near its outer end 13. The stop means 39 divides the spindle 1 into a short spindle portion 41 and a long spindle portion 43. The long spindle portion 43 is slightly longer that the length of the toilet paper roll 3. The stop means 39 comprises a flange 45 extending about the outer periphery of the spindle 1. The outer end 46 of the flange 45, adjacent the short spindle portion 41, forms a stop shoulder. The stop shoulder 46 extends transversely to the longitudinal axis of the spindle. The flange 45 increases in diameter in moving from its outer end 46 towards its inner end 47 adjacent the long spindle portion 43.

In accordance with the present invention the outer diameter Ds1 of the short spindle portion 41 is generally the same as the inner diameter Dc1 of the toilet paper roll core 5. The outer diameter Ds2 of the outer end 46 of the flange 45 is generally equal to the outer diameter Dc2 of the core 5. The outer diameter Ds3 of the inner end 47 of the flange 45 is slightly greater than the outer diameter Ds2 of the outer end 46 of the flange 45. The outer diameter Ds4 of the long spindle portion 43 can be the same as, or slightly less than, the outer diameter Dsl of the short spindle portion 41. The outer end 13 of the spindle 1 is preferably rounded to facilitate its entry into the core 5 as will be described.

In using the spindle 1, the toilet paper roll 3 is centered and pushed onto the spindle 1 with the short spindle portion 41 of the spindle entering snugly into the core 5. Continued pushing of the roll 3 onto the spindle 1 will cause the end 48 of the core 5 to abut the outer end 46 of the flange 45. Further pushing of the roll 3 onto the spindle will cause the coil 7 of paper to slide off the core 5, as shown in FIG. 3, over the flange 45 and onto the long spindle portion 43 where it is freely rotatable. As the coil 7 of paper 9 slides off the core 5 and over the flange 45, the larger diameter inner end 47 of the flange 45, which inner end is just slightly larger than the inner diameter of the coil 7, frictionally prevents the coil from falling freely onto the long spindle portion 43. If the coil 7 were to fall freely onto the long spindle portion 43, there is a possibility of changing the structural integrity of the inner portion of the coil and thus possibly damaging it. Once the coil 7 is on the long spindle portion 41, the core 5 is removed from the short spindle portion 41 and disposed of. Toilet paper 9 is removed from the coil 7 on the long spindle portion 43 as required with the spindle 1, and the coil 7 on it, rotating as the paper 9 is pulled off the coil 7. Initially, the coil 7 may rotate freely on the spindle 1 as the paper is pulled off. During use however, the inner portion of the coil 7 may wrap tightly to the spindle 1 preventing rotation of the coil 7 on the spindle. The paper 9 can still be pulled off in this case since the spindle itself is rotatably mounted.

In a preferred embodiment of the invention, the spindle 1 is employed with a "two-roll" dispenser. The "two-roll" dispenser 49 as shown in FIG. 4 has a base 51. The base 51 as shown in FIGS. 5 and 6 has a back wall 53. The dispenser 49 is adapted to be mounted against a wall "W" via is back wall 53. The back wall 53 has fastener openings 55 adjacent its top edge 57 and fastener openings 59 adjacent its bottom edge 61 through which fasteners (not shown) pass to fasten the dispenser to the wall.

A lower support arm 65 extends outwardly from the back wall 53 adjacent its bottom edge 61. The support arm 65 carries a short mounting member 67 near its outer end 69. The mounting member 67 is in the form of a short tube 71. A tubular enclosure 73 is mounted on the upper part of the back wall 53. The enclosure 73 is centered over the mounting tube 71 and is open at its bottom end 77. The enclosure is sized to enclose a toilet paper coil mounted in the upper portion of the base 51 as will be described. Curved sidewalls 79 may extend vertically between the enclosure 73 and the lower support arm 65 on either side of the back wall 53. The sidewalls 79 can form extensions of wall portions of the enclosure 73, and are formed integrally with the back wall 53 as shown in FIG. 7. The sidewalls 79 are sized to partially enclose a toilet paper coil mounted in the lower portion of the base 51 as will be described.

The base 51 is preferably molded in one piece from suitable plastic material with the lower support arm 65, the mounting member 67, the tubular enclosure 73, and the sidewalls 79 all being integral with the back wall 53.

The dispenser 49 includes spindle means 83 for mounting two toilet paper coils, one on top of the other. The spindle means 83 includes a lower spindle 85 that is adapted to be mounted on the mounting member 67 on the base 51 as will be described. The lower spindle 85 as shown in FIG. 8 has a lower section 87 with a reduced diameter. Slots 89 extend part way into the lower section 87 from the bottom end 90 of the lower spindle 85. The slots 89 are parallel to the longitudinal axis of the lower spindle 85 and divide the lower part of the lower section 87 into resilient arms 91. A flange 93 is provided about the lower section 87 at the bottom end 90. The length L1 between the flange 93 and the shoulder 95 defining the upper end of the lower section 87 is generally equal to the length L1 of the inner wall 97 of the mounting member 67 as seen in FIG. 5.

The lower spindle 85 has a relatively long middle spindle section 99. The middle section 99 has a slightly larger diameter than the lower section 87. Two elongated, inverted u-shaped slots 101 in the wall 103 of the middle spindle section 99 define opposed elongated resilient fingers 105 as shown in FIGS. 8 and 9. Each finger 105 extends upwardly and has a stop member 107 extending laterally outwardly from its upper, free end 109. A curved cam member 111 in the form of a web connects between the stop member 107 and the finger 105. The curved cam surface 113 on the web member 111 extends between the outer surface of the finger 105 and the outer end 115 of the stop member 107.

The lower spindle 85 also has an upper spindle section 119. The upper spindle section 119 is relatively short and has a slightly larger diameter than the diameter of the middle spindle section 99. The upper spindle section 119 has a raised circumferential bead 121 about its lower end 123 adjacent the middle spindle section 99.

The spindle means 83 also has an upper spindle. This upper spindle is identical to spindle 1.

The spindle means 83 further includes a spindle sleeve 155. The spindle sleeve 155 as shown in FIG. 10 has an upper end 157 with the tubular wall 159 tapering inwardly to the upper end 157 as shown at 161. The outer surface 163 of the sleeve 155 can have a roughened area 165 allowing it to be more easily gripped.

The spindle means 83 is assembled as shown in FIG. 11 by slipping the spindle sleeve 155 over the middle spindle section 99 of the lower spindle 85. The tapered upper end 157 of the spindle sleeve 155 lies adjacent to the cam members 111 on the lower spindle 85. The spindle sleeve 155 freely slides on a major portion of the middle spindle section 99 and is also freely rotatable thereon. The upper spindle 1 is mounted on the lower spindle 85 with the upper spindle section 119 of the lower spindle 85 entering into the upper spindle 1 through its open base end 11. The raised bead 121 on the upper spindle section 119 of the lower spindle 85 enters the locking groove 19 on the upper spindle 1 to securely lock the upper and lower spindles together.

The assembled spindle means 83 is now mounted on the base 51 of the dispenser 49 with the lower spindle section 87 of the lower spindle 85 inserted downwardly through the mounting member 67. The resilient arms 91 move inwardly slightly allowing the flange 93 to pass through the mounting member 67. Once the flange 93 is through the member 67, the arms 91 move back outwardly to lock the lower spindle section 87 to the member 67, between flange 93 and shoulder 95. The assembled spindle means 83 extends up into the tubular enclosure 73 on the base 51 with the spindle sleeve 155 and the lower spindle 85 generally located out in the open opposite the side walls 79 and with the upper spindle 1 generally located within the tubular enclosure 73. The spindle sleeve 155 and lower spindle 85 generally define the lower operative position of the dispenser and the upper spindle 1 within the enclosure 73 generally defines the upper storage position of the dispenser. The spindle sleeve 155 is freely slidable on the lower spindle 85 between the cam members 111 and the top of the support arm 65. The outer surface of the spindle sleeve 155 can have a roughened area 165 near its bottom end allowing it to be more easily gripped. Upwardly pointing arrows 203 can be moulded or printed on the outer surface of the sleeve.

The dispenser 49 is provided with a cover 175 to close the top of the tubular enclosure 73. The cover 175, as shown in FIGS. 4, 5 and 6 can comprise a top, domed portion 181 and a tubular skirt portion 183 depending from the peripheral edge of the top domed portion 181. The top portion 181 has a central recess 185 into which the rounded end 13 of the upper spindle 1 snugly projects. The skirt portion 183 fits snugly about the upper end of the enclosure 73. The skirt portion 183 can have a cutout portion 187 at the rear to accommodate the base 51. A slot 189 may be provided at the front of the skirt portion 183 extending up from its free edge 191 to receive a flange 193 extending radially out from the tubular enclosure 73 adjacent its top end 75. A flange 195 also extends radially out from the skirt portion 183 adjacent the slot 189. With the cover 175 mounted over the enclosure 73, the flange 195 on the cover 175 is adjacent the flange 193 on the enclosure 73, and holes 197, 199 on the flanges 193, 195 respectively are aligned. A lock (not shown) can be passed through the aligned holes 197, 199 to lock the cover 175 to the enclosure 73. The cover 175 strengthens the dispenser 49, particularly the spindle means 83 since it is now held securely both top and bottom. The cover also prevents theft or improper use of the top paper coil, and minimizes vandalism of the dispenser. The cover and locking means can take forms other that those described above.

In using the dispenser 49, the cover 175 is removed and a first toilet paper roll is pushed down over the rounded outer end 13 of the upper spindle 1 with its short upper spindle portion 41 snugly entering into the core 5 of the first roll. Continued downward pushing of the first roll causes the end 48 of the core 5 to abut the outer end 46 of the flange 45 on the upper spindle 1. Further pushing slides the coil 7 of toilet paper 9 off the core 5 and onto the lower, long spindle portion 43 of the upper spindle 1. The coil 7 slides freely downwardly on the upper spindle 1 until it abuts on the stop members 107 on the top end of the lower spindle 85. The spindle sleeve 155 is now move upwardly on the lower spindle 85 to have its upper end 157 move along the cam surfaces 113 of cam members 111 camming the fingers 105 and the stop members 107 inwardly into the interior of the lower spindle 85 as shown in FIG. 12. As the stop members 107 move inwardly and move clear of the coil 7 of toilet paper, the coil 7 drops down over the sleeve 155. The sleeve 155 is now moved down on the lower spindle 85 allowing the fingers 105 and stop members 107 to move back out. The coil 7 is now in the lower operative position of the dispenser as shown in FIG. 13. The toilet paper 9 is pulled off the coil 7 on the sleeve 155 as needed through the large open space between the sidewalls 79. The coil 7 is mounted on the sleeve 155 and the sleeve 155 is in turn rotatably mounted on the lower spindle 85. As the toilet paper 9 is pulled off the sleeve 155, and the coil 7 on it, rotate on the lower spindle 85. Initially, the coil 7 may rotate freely on the sleeve 155 as paper 9 is pulled off. During use however, the inner portion of the coil 7 may wrap itself tightly about the sleeve 155. In this case, paper 9 can still be removed from the coil 7 since the sleeve 155 itself is rotatably mounted on the lower spindle 85.

A second roll of toilet paper is then mounted on the upper end of the upper spindle, and pushed down to slide its coil 7A of toilet paper off its core and onto the upper spindle. The second coil 7A rests on the stop members 107 above the first coil 7 as shown in FIG. 13. The second core is disposed of. The second coil 7A is located generally within the tubular enclosure 73 and is now in the upper storage position of the dispenser. The cover 175 is then locked onto the enclosure 73. When the first coil 7 of toilet paper is used up, the sleeve 155 is raised to cam in the stop members 107 and allow the second coil 7A to drop down onto the sleeve and lower spindle. A third coil is loaded onto the top spindle during servicing of the dispenser to be in position to be lowered to an operative position when the second coil is all used up. An opening 201 may be provided in the enclosure 73 to permit a visual check of the second roll in the upper storage position.

If desired, stop means 171 can be provided near the top of the middle spindle portion 99 of the lower spindle 85 as shown in FIG. 8. The stop means 171 are located just above the stop members 107 and limit the upward movement of the sleeve 155.

I claim:

1. A process for mounting a portion of a toilet paper roll on a spindle, the toilet paper roll being comprised of a long sheet of toilet paper wound in a coil on a core, the spindle having a generally cylindrical shape with rigid core removing means in the form of a projection near a first end thereof and with a diameter of the spindle at the first end being equal to the inner diameter of the core; the process comprising: providing a toilet paper roll which has a sheet of toilet paper wound on the core in a coil and removable therefrom when mounting the roll on the spindle; mounting the coil on the spindle by pushing the roll against the first end of the spindle to insert the first end into the core, continuing to push the roll onto the spindle until an end of the core abuts the core removing means on the spindle, and then pushing the coil off the core and over the core removing means onto the spindle without disturbing the coil; and disposing of the core.

2. A process as claimed in claim 1 wherein said process comprises first forming the toilet paper roll such that an inner end of the sheet of toilet paper is adhered onto the core with fugative glue, and then allowing the glue to dry after the roll is formed.

3. A spindle for use in mounting thereon a portion of a roll of toilet paper composed of a long sheet of toilet paper wound in a coil on a core; the spindle having: a generally cylindrical shape with two ends; mounting means at one end of the spindle for use in rotatably mounting the spindle; core removing means near the other end of the spindle for use in removing the core from a roll of toilet paper as the roll is pushed onto the other end of the spindle so as to mount only the coil on the spindle, the core removing means comprising a flange extending circumferentially about the spindle near its other end, the flange having two ends, a first end of the flange nearest the other end of the spindle forming a fixed stop surface that is perpendicular to and extends outwardly from, the cylindrical surface of the spindle, the first end of the flange having an outer diameter equal to an outer diameter of the core to be removed, a second end of the flange, nearest the one end of the spindle having a slightly greater diameter than the first end of the flange so as to slightly frictionally hold the coil of toilet paper as it is pushed off the core onto the spindle.

4. A spindle for use in mounting thereon a portion of a roll of toilet paper composed of a long sheet of toilet paper wound in a coil on a core; the spindle having: a generally cylindrical surface with two ends; mounting means at one end of the spindle for use in rotatably mounting the spindle; rigid core removing means near the other end of the spindle for use in removing the core from a roll of toilet paper as the roll is pushed onto the other end of the spindle so as to mount only the coil on the spindle, the core removing means extending abruptly, radially outwardly from the cylindrical surface of the spindle, a diameter of the spindle adjacent the core removing means on a side closest to the other end of the spindle being equal to the inner diameter of the core.

5. A spindle as claimed in claim 4 wherein the core removing means has a fixed stop surface perpendicular to the cylindrical surface of the spindle, the stop surface facing towards the other end of the spindle.

6. A spindle as claimed in claim 5 wherein the core removing means comprises a flange extending circumferentially about the spindle near its other end, the flange having two ends, the one end of the flange nearest the other end of the spindle forming the stop surface and having an outer diameter equal to the outer diameter of the core to be removed.

7. A spindle as claimed in claim 6 wherein the other end of the flange, nearest the one end of the spindle, has a slightly greater diameter than the one end of the flange to slightly frictionally hold the coil of toilet paper as it is pushed off the core into the spindle.

8. A two roll toilet paper dispenser with each roll of toilet paper initially composed of a long sheet of toilet paper wound in a coil on a core; the dispenser having: a base; a support arm extending perpendicularly from the base; spindle means mounted on the support arm for holding two coils of toilet paper thereon; means on the base for use in mounting the dispenser on a support surface with the spindle means extending upwardly from the support arm; the double means having: a lower spindle with upper and lower ends and an upper spindle with upper and lower ends; the lower spindle mounted by its lower end on the support arm, the upper spindle mounted by its lower end on the upper end of the lower spindle, the upper spindle having core removing means solely near its upper end for use in removing the core from a roll of toilet paper as the roll is pushed onto the upper end of the upper spindle so as to mount only the coil on the spindle means.

9. A dispenser as claimed in claim 8 wherein the core removing means has a stop surface perpendicular to, and extending outwardly from, the cylindrical surface of the upper spindle, the stop surface facing towards the upper end of the upper spindle.

10. A dispenser as claimed in claim 9 wherein the core removing means comprises a flange extending circumferentially about the upper spindle near its upper end, the flange having two ends, the one end of the flange nearest the upper end of the upper spindle forming the stop surface and having an outer diameter equal to the outer diameter of a core to be removed.

11. A dispenser as claimed in claim 10 wherein the other end of the flange, nearest the lower end of the upper spindle, has a slightly greater diameter than the one end of the flange to slightly frictionally hold the coil of toilet paper as it is pushed off the core onto the spindle means.

12. A dispenser as claimed in claim 8 including stop means on the lower spindle near its upper end for supporting a coil of toilet paper on the upper spindle in a storage position.

13. A dispenser as claimed in claim 12 including means for moving the stop means to allow the supported coil of toilet paper in the storage position to drop down onto the lower spindle to an operative dispensing position.

14. A dispenser as claimed in claim 13 wherein the stop means comprises resilient fingers on the lower spindle, and the moving means comprise a sleeve slidably and rotatably mounted on the lower spindle for moving the fingers.

15. A dispenser as claimed in claim 8 including an enclosure extending laterally from the base above the support arm, the enclosure substantially enclosing the upper spindle.

* * * * *